US011790876B1

(12) United States Patent
Kurek et al.

(10) Patent No.: US 11,790,876 B1
(45) Date of Patent: Oct. 17, 2023

(54) MUSIC TECHNIQUE RESPONSIBLE FOR VERSIONING

(71) Applicant: Library X Music Inc., South Pasadena, CA (US)

(72) Inventors: Maciej Kurek, Warsaw (PL); Antony Demekhin, Los Angeles, CA (US); Filip Mitrovic, Los Angeles, CA (US)

(73) Assignee: Library X Music Inc., South Pasadena, CA (US)

( * ) Notice: Subject to any disclaimer, the term of this patent is extended or adjusted under 35 U.S.C. 154(b) by 0 days.

(21) Appl. No.: 18/204,411

(22) Filed: Jun. 1, 2023

Related U.S. Application Data

(60) Provisional application No. 63/347,616, filed on Jun. 1, 2022.

(51) Int. Cl.
*G10H 1/00* (2006.01)

(52) U.S. Cl.
CPC ..... *G10H 1/0025* (2013.01); *G10H 2210/036* (2013.01); *G10H 2210/061* (2013.01); *G10H 2210/066* (2013.01); *G10H 2210/111* (2013.01); *G10H 2210/125* (2013.01); *G10H 2210/145* (2013.01); *G10H 2210/185* (2013.01); *G10H 2210/335* (2013.01); *G10H 2210/576* (2013.01)

(58) Field of Classification Search
CPC ..... G10H 1/0025; G10H 2210/036; G10H 2210/066; G10H 2210/111; G10H 2210/125; G10H 2210/145; G10H 2210/185; G10H 2210/335; G10H 2210/576
See application file for complete search history.

(56) References Cited

U.S. PATENT DOCUMENTS 4,951,544 A * 8/1990 Minamitaka ..... G10H 1/38 84/613
2008/0300702 A1* 12/2008 Gomez ..... G10L 25/48 700/94
2023/0114371 A1* 4/2023 Lopez Duarte ..... G10H 1/0025 463/35

FOREIGN PATENT DOCUMENTS

WO WO-2021202868 A1 * 10/2021

OTHER PUBLICATIONS

Yesiler et al., Audio Based Musical Version Identification Elements and challenges, IEEE Signal Processing Magazine, Nov. 2021. (Year: 2021).*

* cited by examiner

*Primary Examiner* — Jianchun Qin
(74) *Attorney, Agent, or Firm* — Georgiy L. Khayet

(57) ABSTRACT

Systems and methods for versioning audio elements used in generation of music are provided. An example method includes receiving musical format data associated with a plurality of audio elements of a melody; determining, based on the musical format data, harmonic and melodic characteristics of each of the plurality of audio elements; matching the harmonic and melodic characteristics to a plurality of chord progressions using predetermined music theory rules, counterpoint rules, and rhythm matching rules; deriving, based on the matching and predetermined melodic movement rules, from the plurality of chord progressions, melodic movement characteristics applicable to using in versioning; and creating, based on the predetermined music theory rules and the melodic movement characteristics, versions of the audio elements that match the chord progressions.

20 Claims, 4 Drawing Sheets

MUSIC TECHNIQUE RESPONSIBLE FOR VERSIONING

CROSS-REFERENCE TO RELATED APPLICATIONS

The present application claims priority of U.S. Provisional Patent Application No. 63/347,616 filed on Jun. 1, 2022, entitled "MUSIC ALGORITHM RESPONSIBLE FOR VERSIONING." The subject matter of aforementioned application is incorporated herein by reference in its entirety for all purposes.

TECHNICAL FIELD

The present disclosure relates generally to data processing, and, more specifically, to versioning audio elements used in music generation.

BACKGROUND

The field of artificial intelligence (AI) generated, algorithmic, and automated music production is still in its early days. Several conventional approaches for AI music creation have so far resulted in generation of scalable but low quality and somewhat soulless music when completely unsupervised or unedited by a human. Some companies have produced "AI music," but in most cases the best examples of this conventional technology still require a human touch to make the music sound good.

Most current "AI music" projects and companies use a fully generative model. A neural network learns according to one of two common methods. According to the first method, a neural network can learn certain musical rules and patterns from a dataset of pre-existing musical compositions in Musical Instrument Digital Interface (MIDI) format and "learn" how to generate its own original melodies, chord progressions, basslines, drum patterns, and rhythms using the MIDI format. The technology then synthesizes this MIDI data into audio using software instrument synthesis. The melodies and chords are conventionally created based on predetermined chord data stored in a database in accordance with a predefined algorithm. The limitation of this approach in achieving a quality end result that sounds "good" and "emotionally relatable" to a human listener is two-fold. First, the melodies and chords that typically affect human emotions are created by an algorithm with no ability to validate their emotional impact. Second, these melodic ideas are expressed as audio music utilizing software synthesis which lacks the expressiveness and emotional performance of a human playing an instrument. According to the second method, a neural network learns from a data set of labeled spectrograms, or visual representations of audio waveforms, and generates new spectrograms which are transformed back into an audio waveform format. This format is also limited in achieving a quality end result that is "emotionally relatable" to a human listener, due to the random nature of the melody and chord selection. The results produce a lower quality output due to audio noise associated with the method of transforming audio into spectrograms and back into audio. Finally, most spectrogram systems have to be trained on large audio waveform data sets of copyrighted musical works, which limits the commercial viability of the system's output and increases the chances of copyright infringement.

SUMMARY

This summary is provided to introduce a selection of concepts in a simplified form that are further described in the Detailed Description below. This summary is not intended to identify key features or essential features of the claimed subject matter, nor is it intended to be used as an aid in determining the scope of the claimed subject matter.

According to one example embodiment of the present disclosure, a system for versioning audio elements used in generation of music is provided. The system may include an audio element generation engine and a memory unit in communication with the audio element generation engine. The audio element generation engine may be configured to receive musical format data associated with a plurality of audio elements of a melody and determine, based on the musical format data, harmonic and melodic characteristics of each of the plurality of audio elements. The audio element generation engine may be further configured to match the harmonic and melodic characteristics to a plurality of chord progressions using predetermined music theory rules, counterpoint rules, and rhythm matching rules. Based on the matching and predetermined melodic movement rules, the audio element generation engine may derive, from the plurality of chord progressions, melodic movement characteristics applicable to using in versioning. Based on the predetermined music theory rules and the melodic movement characteristics, the audio element generation engine may create versions of the audio elements that match the chord progressions. The memory unit may store at least the plurality of chord progressions, the predetermined music theory rules, the counterpoint rules, and the rhythm matching rules.

According to another embodiment of the present disclosure, a method for versioning audio elements used in generation of music is provided. The method may commence with receiving musical format data associated with a plurality of audio elements of a melody. The method may proceed with determining, based on the musical format data, harmonic and melodic characteristics of each of the plurality of audio elements. The method may further include matching the harmonic and melodic characteristics to a plurality of chord progressions using predetermined music theory rules, counterpoint rules, and rhythm matching rules. The method may proceed with deriving melodic movement characteristics applicable to use in versioning. The melodic movement characteristics may be derived based on the matching and predetermined melodic movement rules and the plurality of chord progressions. The method may further include creating, based on the predetermined music theory rules and the melodic movement characteristics, versions of the audio elements that match the chord progressions.

According to another example embodiment, provided is a non-transitory computer-readable storage medium having instructions stored thereon, which, when executed by one or more processors, cause the one or more processors to perform steps of the method for versioning audio elements used in generation of music.

Other example embodiments of the disclosure and aspects will become apparent from the following description taken in conjunction with the following drawings.

BRIEF DESCRIPTION OF DRAWINGS

Exemplary embodiments are illustrated by way of example and not limitation in the figures of the accompanying drawings, in which like references indicate similar elements.

DETAILED DESCRIPTION

Figure 1:
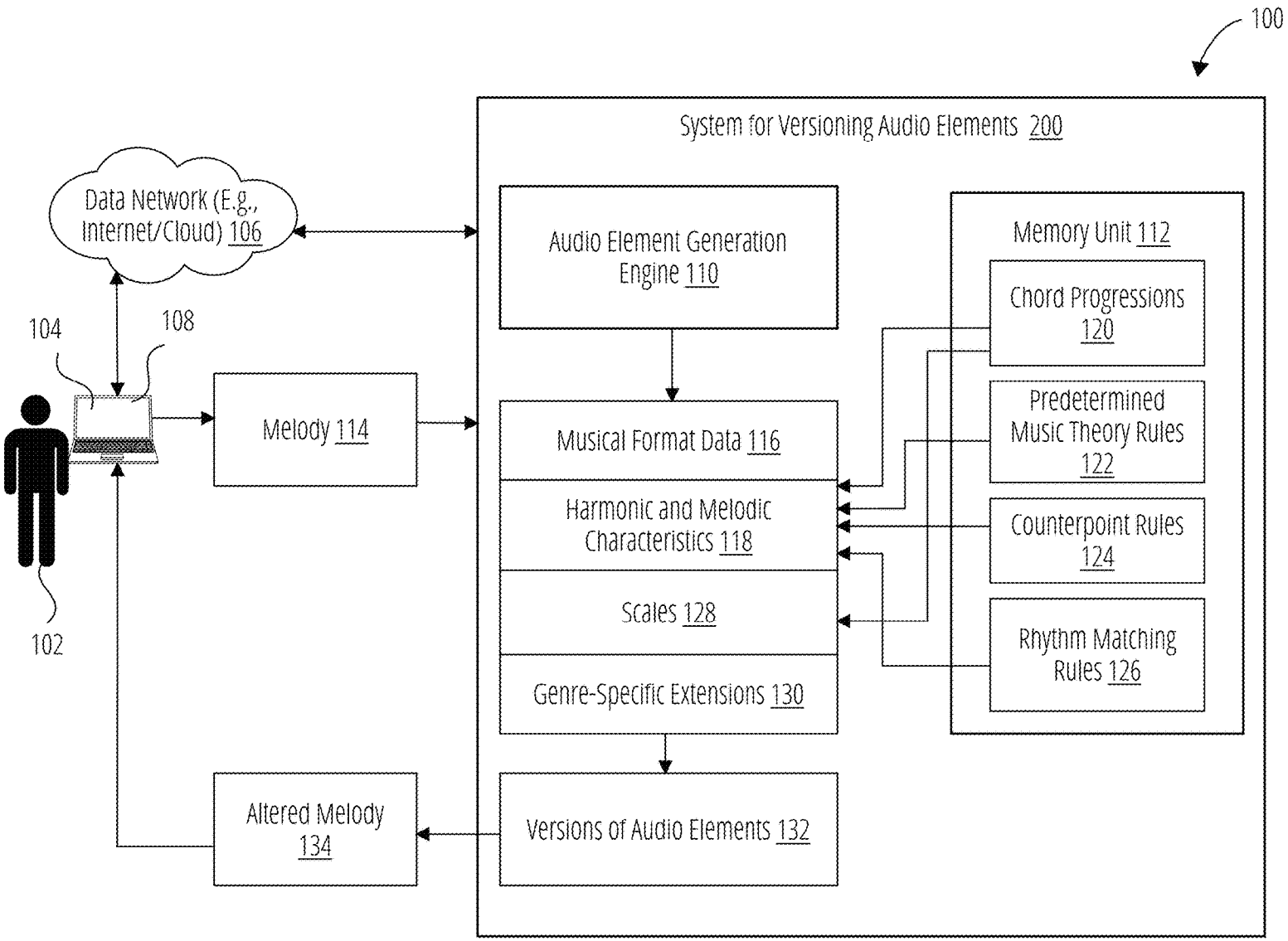
FIG. 1 illustrates an environment within which systems and methods for versioning audio elements used in generation of music can be implemented, in accordance with some embodiments.

The following detailed description of embodiments includes references to the accompanying drawings, which form a part of the detailed description. Approaches described in this section are not prior art to the claims and are not admitted to be prior art by inclusion in this section. The drawings show illustrations in accordance with example embodiments. These example embodiments, which are also referred to herein as "examples," are described in enough detail to enable those skilled in the art to practice the present subject matter. The embodiments can be combined, other embodiments can be utilized, or structural, logical, and operational changes can be made without departing from the scope of what is claimed. The following detailed description is, therefore, not to be taken in a limiting sense, and the scope is defined by the appended claims and their equivalents.

Embodiments of the present disclosure are directed to systems and methods for versioning audio elements used in generation of music. To compose original music, the systems and methods use a unique dataset of short, modular audio elements and audio building blocks that are created and curated by humans or generated through audio synthesis as a result of machine learning. The system includes an audio element generation engine that relies on a broad, diverse set of audio elements or building blocks to offer a broad and creatively flexible experience for the end user when generating audio tracks. To that end, the more unique audio elements that are available to the system across every key, tempo, genre, and mood, the better and more diverse the audio track output is.

In order to scale the human-recorded or human-produced audio elements, the audio element generation engine uses a music technique responsible for versioning of audio elements. Specifically, the audio element generation engine looks at musical format data, e.g., MIDI data, of a melody to analyze the harmonic and melodic characteristics of each audio element of the melody. The audio element generation engine then automatically matches the harmonic and melodic characteristics with all the available chord progressions using predetermined original music theory rules, counterpoint rules, and rhythm matching rules. Based on the matching and predetermined melodic movement rules, the audio element generation engine may derive, from the plurality of chord progressions, melodic movement characteristics applicable to use in versioning. Based on the predetermined music theory rules and the melodic movement characteristics, the audio element generation engine may create versions of the audio elements that match the chord progressions. Therefore, the audio element generation engine can alter existing melodies to match different chord progressions that otherwise would contain a few "wrong" notes, by creating versions of that melody where the "wrong" notes are transposed or "nudged" to fit the specific chord progression.

Referring now to the drawings, various embodiments are described in which like reference numerals represent like parts and assemblies throughout the several views. It should be noted that the reference to various embodiments does not limit the scope of the claims attached hereto. Additionally, any examples outlined in this specification are not intended to be limiting and merely set forth some of the many possible embodiments for the appended claims.

FIG. 1 is an environment 100 in which systems and methods for versioning audio elements used in generation of music can be implemented. The environment 100 may include a user 102, a client device 104 associated with the user 102, a system 200 for versioning audio elements used in generation of music (also referred herein to as a system 200), and a data network 106 (e.g., an Internet or a cloud). The client device 104 may include a personal computer (PC), a desktop computer, a laptop, a smartphone, a tablet, and so forth. The client device 104 may communicate with the system 200 via the data network 106. In an example embodiment, the client device 104 may have a user interface 108 associated with the system 200. In a further example embodiment, a web browser (not shown) may be running on the client device 104 and displayed using the user interface 108.

The data network 106 may include the Internet or any other network capable of communicating data between devices. Suitable networks may include or interface with any one or more of, for instance, a local intranet, a corporate data network, a data center network, a home data network, a Personal Area Network, a Local Area Network (LAN), a Wide Area Network (WAN), a Metropolitan Area Network, a virtual private network, a Wi-Fi® network, a storage area network, a frame relay connection, an Advanced Intelligent Network connection, a synchronous optical network connection, a digital T1, T3, E1 or E3 line, Digital Data Service connection, Digital Subscriber Line connection, an Ethernet connection, an Integrated Services Digital Network line, a dial-up port such as a V.90, V.34 or V.34bis analog modem connection, a cable modem, an Asynchronous Transfer Mode connection, or a Fiber Distributed Data Interface or Copper Distributed Data Interface connection. Furthermore, communications may also include links to any of a variety of wireless networks, including Wireless Application Protocol, General Packet Radio Service, Global System for Mobile Communication, Code Division Multiple Access or Time Division Multiple Access, cellular phone networks (e.g., a Global System for Mobile (GSM) communications network, a packet switching communications network, a circuit switching communications network), Global Positioning System, cellular digital packet data, Research in Motion, Limited duplex paging network, Bluetooth® radio, or an IEEE 802.11-based radio frequency network, a Frame Relay network, an Internet Protocol (IP) communications network, or any other data communication network utilizing physical layers, link layer capability, or network layers to carry data packets, or any combinations of the above-listed data networks. The data network 106 can further include or interface with any one or more of a Recommended Standard 232 (RS-232) serial connection, an IEEE-1394 (FireWire) connection, a Fiber Channel connection, an IrDA (infrared) port, a Small Computer Systems Interface connection, a Universal Serial Bus (USB) connection or other wired or wireless, digital or analog interface or connection, mesh or Digi® networking. In some embodiments, the data network 106 may include a corporate network, a data center network, a service provider network, a mobile operator network, or any combinations thereof.

The system 200 may include an audio element generation engine 110 and a memory unit 112 in communication with the audio element generation engine 110. The audio element generation engine 110 may be configured to receive a melody 114 from the user 102 via the user interface 108. The audio element generation engine 110 may process the melody 114 to determine musical format data 116 associated with a plurality of audio elements of the melody 114. In an example embodiment, the musical format data 116 may include MIDI data, Open Sound Control (OSC) data, Audio Units data, Virtual Studio Technology (VST) format data, Digital Multiplex (DMX) data, control voltage (CV)/Gate data, and so forth.

MIDI format is a technical standard that describes a protocol, digital interface, and file format used in electronic music devices and software applications. The MIDI format enables communication between electronic musical instruments, such as keyboards, synthesizers, and drum machines, as well as with computer software that generates or processes sound. The MIDI format is a standardized format for storing musical information, such as notes, timing, and instrument data. MIDI files do not contain actual sound recordings, but instead contain instructions for electronic instruments or software to play back the music described in the file. A MIDI file typically consists of a series of messages that describe the musical performance, such as note on/off messages, velocity (how hard a note was struck), pitch bend, modulation, and program change messages. These messages are organized in a standardized way to create a musical performance. MIDI data can also include other data such as lyrics, tempo changes, and markers. MIDI data can be used to store and exchange musical performances between different software and hardware devices. MIDI data can be edited and manipulated using specialized software, enabling musicians and producers to create and modify musical performances with a high degree of precision and control.

OSC is a protocol for communicating musical performance data over a network. The OSC protocol is designed to be more flexible than the MIDI format, allowing for the transmission of more complex data types and allowing for more precise control over musical parameters.

Audio Units are software components that can be used within digital audio workstations to process audio data. The Audio Units allow for real-time audio processing and can be used to create effects, synthesizers, and other audio processing tools.

VST is a plugin format used by many digital audio workstations to add functionality, such as effects and virtual instruments, to a digital audio workstation.

DMX is a protocol used for controlling stage lighting and other visual effects. DMX allows for the control of multiple lighting fixtures from a single controller.

CV/Gate is an analog standard used for controlling analog synthesizers and other electronic musical instruments. CV/Gate uses a control voltage (CV) signal to control pitch and other parameters and a gate signal to trigger notes.

Upon determining the musical format data 116, the audio element generation engine 110 may analyze the musical format data 116 and determine, based on the analysis, harmonic and melodic characteristics 118 of each of the plurality of audio elements of the melody 114. The audio element generation engine 110 may automatically match the harmonic and melodic characteristics 118 to a plurality of chord progressions 120 stored in the memory 404 of FIG. 4. The matching may be performed using predetermined music theory rules 122, counterpoint rules 124, and rhythm matching rules 126 stored in the memory 404.

Based on the matching and predetermined melodic movement rules, the audio element generation engine 110 may derive, from the plurality of chord progressions, melodic movement characteristics applicable to using in versioning. The melodic movement characteristics may include gradual steps treated as scales and leaps treated as arpeggios (chord notes). The audio element generation engine 110 may further derive, from the chord progressions 120, scales 128 applicable to using in versioning.

The audio element generation engine 110 may further determine genre-specific extensions 130 associated with the plurality of audio elements. In an example embodiment, the genre-specific extensions 130 may be determined by searching, in the plurality of audio elements, for two audio elements that play the same or similar rhythm or two audio elements where one audio element is stagnant and the other audio element moves around in a miscellaneous rhythm.

Based on the predetermined music theory rules and the melodic movement characteristics, and in some embodiments further based on the genre-specific extensions 130, the audio element generation engine 110 may create versions 132 of the audio elements that match the chord progressions 120. The altering may include determining notes that do not match one of the chord progressions 120 and transposing the notes to fit the one of the chord progressions 120. The audio element generation engine 110 may create an altered melody 134 based on the versions 132 of the audio elements and provide the altered melody 134 to the user 102.

The memory unit 112 may be in communication with the audio element generation engine 110 and may store at least the plurality of chord progressions, the predetermined music theory rules 122, the counterpoint rules 124, the rhythm matching rules 126, and any other data needed by the audio element generation engine 110 to generate the versions 160 of the audio elements.

Figure 2:
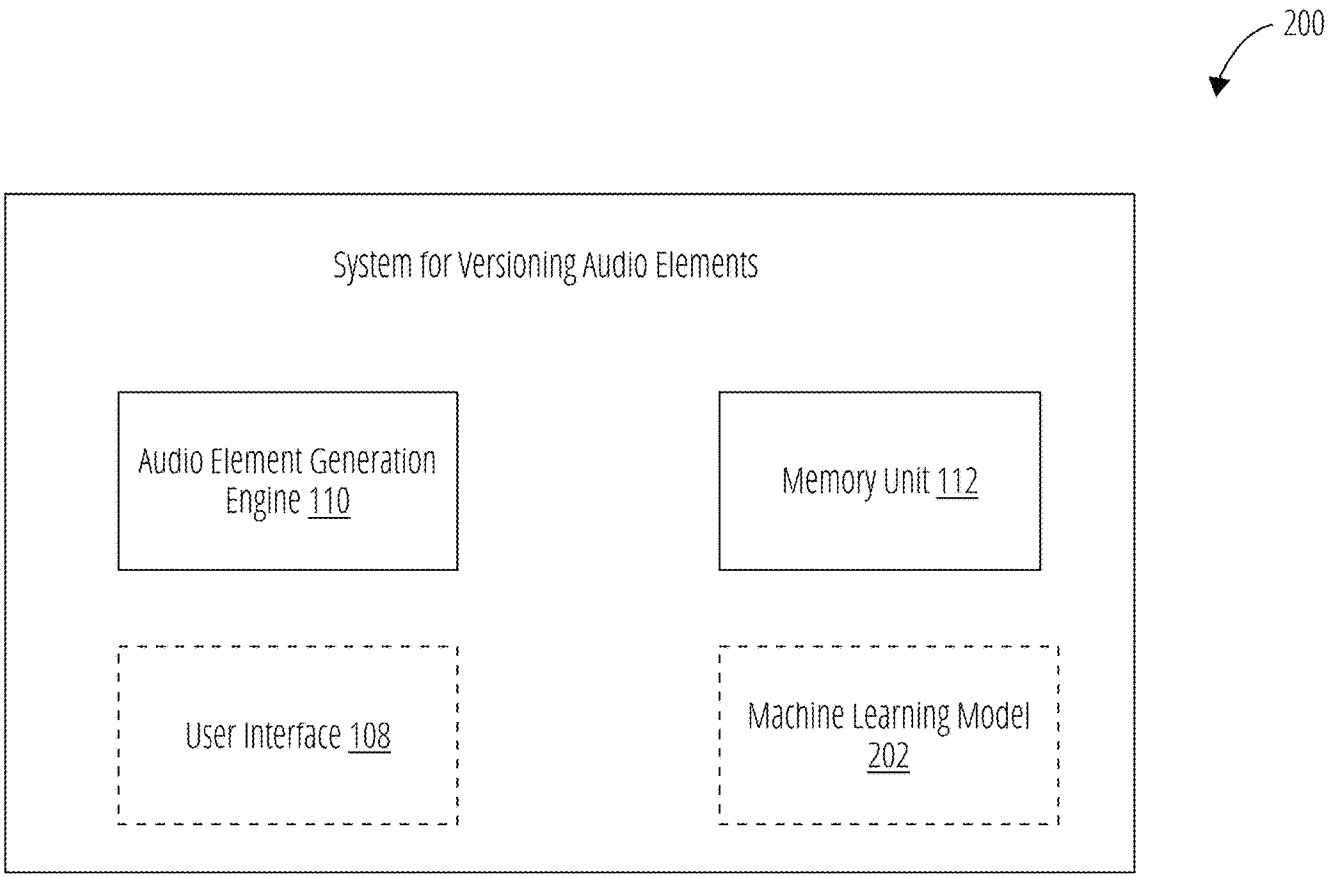
FIG. 2 is a block diagram showing a system for versioning audio elements used in generation of music, according to an example embodiment.

FIG. 2 is a block diagram showing a structure of a system 200 for versioning audio elements used in generation of music, according to an example embodiment. The system 200 may include an audio element generation engine 110, a memory unit 112 in communication with the audio element generation engine 110, and optionally a user interface 108 and a machine learning model 202.

To compose original music, the audio element generation engine 110 may use a unique dataset of short, modular audio elements and audio building blocks which are created and curated by humans. The audio elements and audio building blocks may include musical format data such as MIDI data, OSC data, Audio Units data, VST format data, DMX data, CV/Gate data, and so forth. The audio element generation engine 110 may rely on a broad, diverse set of audio elements or audio building blocks to offer a broad and creatively flexible experience for an end user when generating audio tracks. To that end, the more unique audio elements that are available to the audio element generation engine 110 across every key, tempo, genre, and mood, the better and more diverse the audio track output is.

In order to scale the human-recorded or human-produced audio elements, the audio element generation engine 110 is configured to perform versioning of audio elements. Specifically, the audio element generation engine 110 may analyze musical format data (e.g., MIDI data) of a melody to determine and analyze the harmonic and melodic characteristics of each audio element of the melody. The audio element generation engine 110 may then automatically match the harmonic and melodic characteristics of the melody with all the available chord progressions, using predetermined original music theory rules, counterpoint rules, and rhythm matching rules.

In addition to standard music theory rules, the audio element generation engine 110 can follow custom, unique rules specifically developed for being used by the system 200 for versioning. One such rule is related to melodic movement characteristics. Every melodic movement is divided into two categories: a) gradual steps and b) leaps. The gradual steps are treated as scales, and the leaps are treated as arpeggios (chord notes). The audio element generation engine 110 may automatically derive all possible scales that can be used for versioning from the underlying chord progressions. The gradual movement can start on a non-chord note, but has to land on a chord note. Leaps always have to hit the chord notes implied in the underlying chord progression.

In addition to chord notes implied in the underlying chord progressions, the audio element generation engine 110 may also be configured to determine and analyze genre-specific extensions that are specifically created and machine-learning enabled. For example, the audio element generation engine 110 can conclude, using the machine learning model 202, that a particular setting or pattern such as, for example, a 9th interval in a melody over a subdominant chord (IV9) is considered trendy in 2020, but not in 2022. The audio element generation engine 110 may be configured to update itself, using the machine learning model 202, and "shed its skin" in order to always remain relevant and generate modern-sounding tracks.

In an example embodiment, the genre-specific extensions may be associated with the main rhythm matching rule, which follows the basic principle of "play together or stay out of the way." This means that if it is intended to match rhythms of a particular register such as the Bass register and a Chords register, the audio element generation engine 110 searches for either two elements that play the same or similar rhythm (same or similar defined by 80% or more simultaneous notes) or the audio element generation engine 110 searches for two elements where one is stagnant (long notes that only trigger downbeats of each chord change) and the other moves around in a miscellaneous rhythm. This concept applies to many genre-specific extensions and rules, for example, matching kick drum hits and bassline rhythms in hip-hop music. Furthermore, typical, genre-specific rhythmic patterns may be precisely defined for formulaic styles of music like reggaeton, house, dance, trap, and so forth.

Next, the audio element generation engine 110 may take the original melody and alter the melody by creating versions of audio elements, i.e., new audio element derivatives, that work across all the remaining chord progressions. This process is called nudging. Nudging is defined as follows: the audio element generation engine 110 can alter existing melodies to match different chord progressions that otherwise would contain a few "wrong" notes, by creating versions of that melody where the "wrong" notes are transposed or "nudged" to fit the specific chord progression. This technique is especially seamless with MIDI melodies, because they can easily be transposed to desired pitches. The method also works with monophonic audio melodies via pitch-shifting. The altered melody may be provided to the user via the user interface 108.

Figure 3:
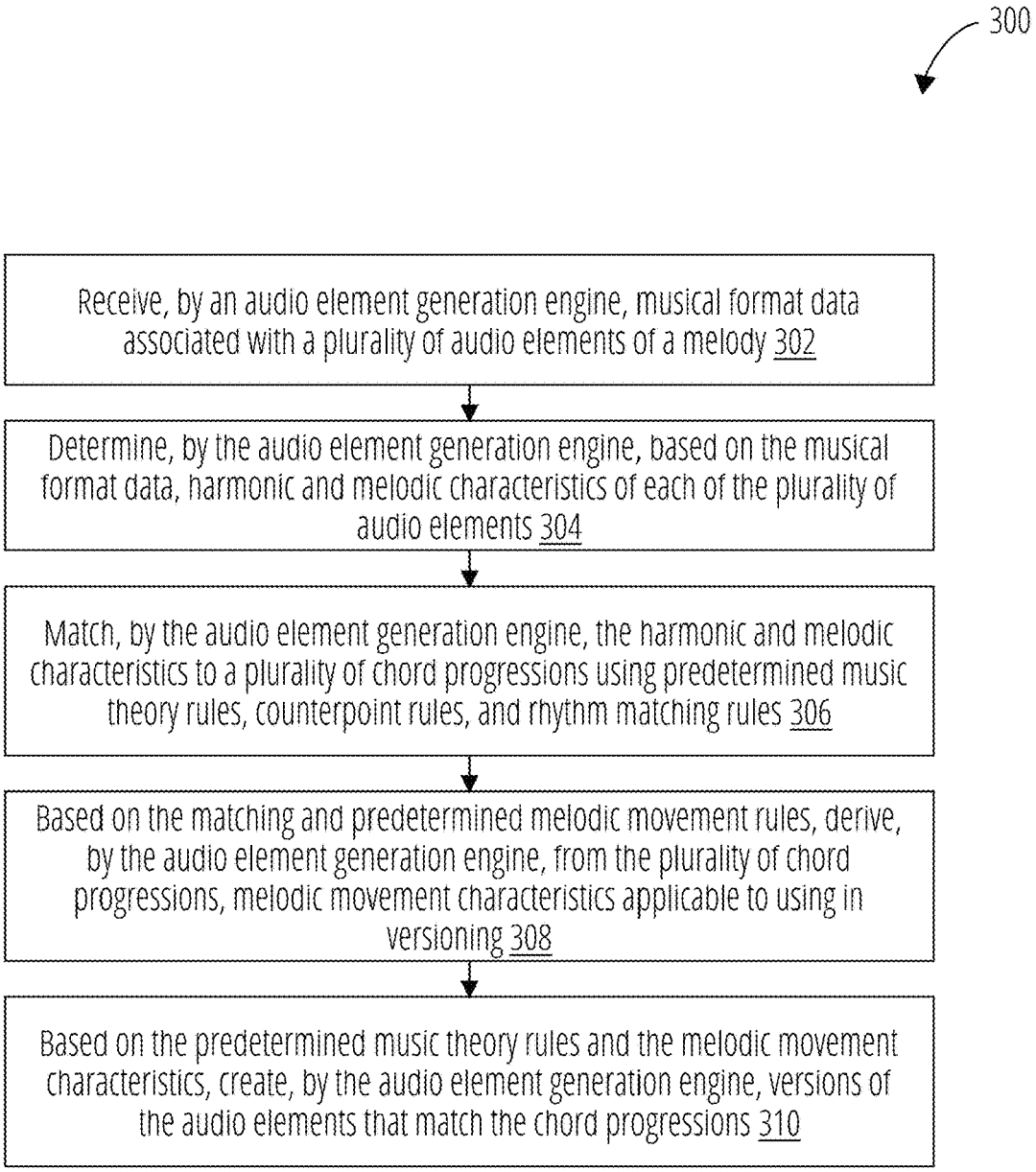
FIG. 3 illustrates a method for versioning audio elements used in generation of music in accordance with one embodiment.

FIG. 3 is a flow chart of a method 300 for versioning audio elements used in generation of music, according to one example embodiment. In some embodiments, the operations of the method 300 may be combined, performed in parallel, or performed in a different order. The method 300 may also include additional or fewer operations than those illustrated. The method 300 may be performed by processing logic that may comprise hardware (e.g., decision making logic, dedicated logic, programmable logic, and microcode), software (such as software run on a general-purpose computer system or a dedicated machine), or a combination of both.

The method 300 may commence in block 302 with receiving, by an audio element generation engine, musical format data associated with a plurality of audio elements of a melody. The audio element generation engine may receive the melody from the user. In an example embodiment, the musical format data may include MIDI data, OSC data, Audio Units data, a VST format data, DMX data, CV/Gate data, and so forth.

In block 304, the method 300 may proceed with determining, by the audio element generation engine, harmonic and melodic characteristics of each of the plurality of audio elements. The harmonic and melodic characteristics may be determined based on the musical format data. In an example embodiment, the harmonic and melodic characteristics may include one or more of the following: a key, a tempo, a genre, a rhythm, a mood, and so forth.

In block 306, the method 300 may include automatically matching, by the audio element generation engine, the harmonic and melodic characteristics to a plurality of chord progressions using predetermined music theory rules, counterpoint rules, and rhythm matching rules. In an example embodiment, the method 300 may optionally include matching the plurality of chord progressions to the harmonic and melodic characteristics associated with the melody, followed by matching the plurality of chord progressions to a bassline and to a drum pattern associated with the melody. The bassline and the drum pattern may be determined based on the harmonic and melodic characteristics and rhythmic characteristics of the plurality of audio elements.

In block 308, the method 300 may proceed with deriving, by the audio element generation engine, melodic movement characteristics applicable to use in versioning. The melodic movement characteristics may be derived from the plurality of chord progressions based on the matching and predetermined melodic movement rules. In an example embodiment, the melodic movement characteristics may include gradual steps and leaps. The gradual steps may include scales and the leaps may include arpeggios. The gradual steps may start on a non-chord note and land on a chord note. The leaps may hit chord notes presented in the chord progression.

In block 310, the method 300 may include creating, by the audio element generation engine, versions of the audio elements that match the chord progressions. The versions of the audio elements may be created based on the predetermined music theory rules and the melodic movement characteristics. In an example embodiment, the creation of the versions of the audio elements may include determining, in the audio elements, notes that do not match one of the plurality of chord progressions and transposing the notes to fit the one of the plurality of chord progressions.

In an example embodiment, the method 300 may further include determining genre-specific extensions associated with the plurality of audio elements and altering the genre-specific extensions to match predetermined genre-specific extensions. In this embodiment, the creation of the versions of the audio elements may be further based on the altered genre-specific extensions. In an example embodiment, the predetermined genre-specific extensions may be set and updated using a machine learning model. The genre-specific extensions may be determined by searching, in the plurality of audio elements, for two audio elements that play substantially the same or similar rhythm and/or searching for two audio elements where a first audio element is stagnant and a second audio element moves around in a miscellaneous rhythm.

The method 300 may further include altering the melody based on the versions of the audio elements to create an altered melody. The method 300 may proceed with providing the altered melody to the user.

Figure 4:
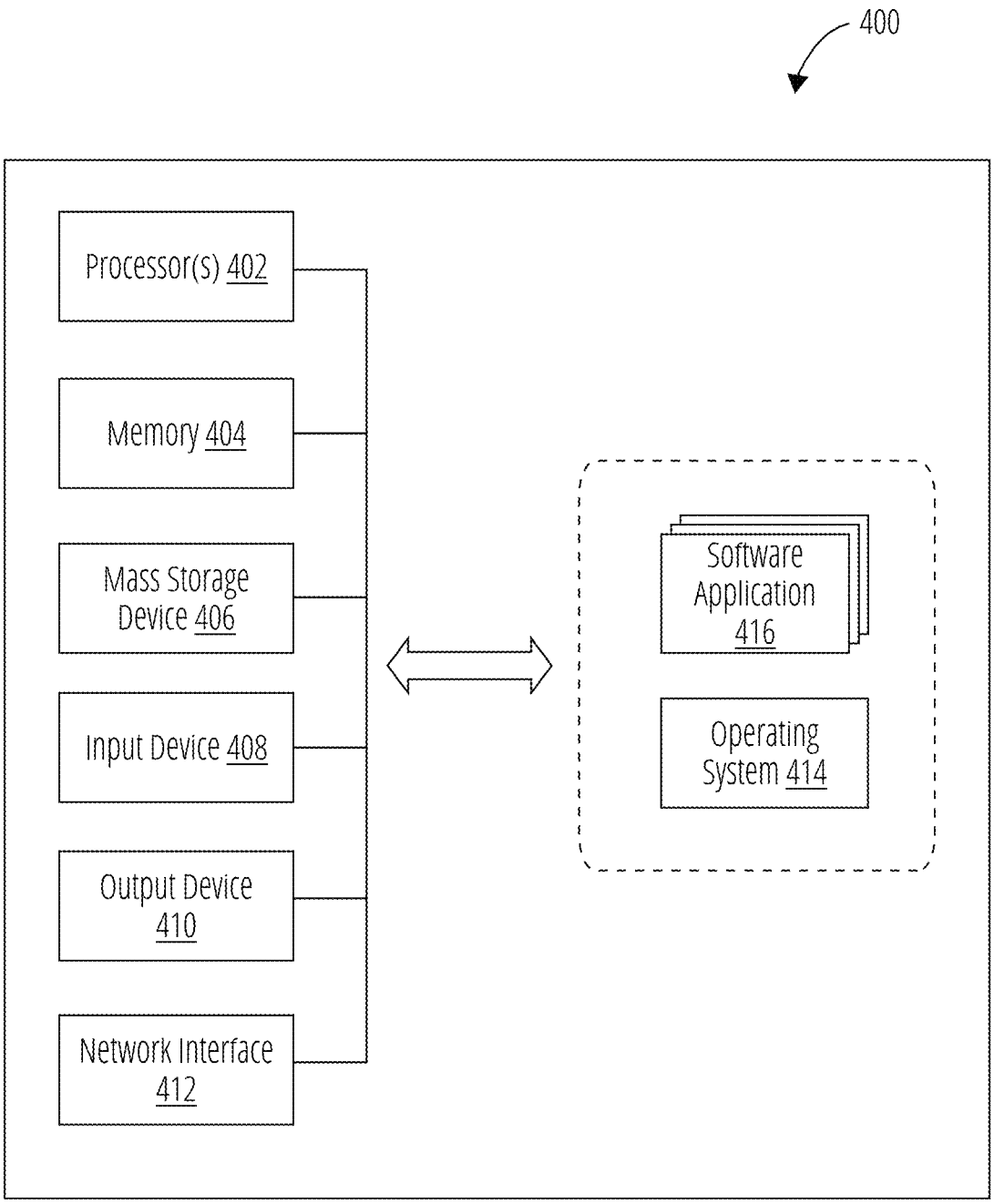
FIG. 4 is a high-level block diagram illustrating an example computer system, within which a set of instructions for causing the machine to perform any one or more of the methodologies discussed herein can be executed.

FIG. 4 is a high-level block diagram illustrating an example computer system 400, within which a set of instructions for causing the machine to perform any one or more of the methodologies discussed herein can be executed. The computer system 400 may include, refer to, or be an integral part of, one or more of a variety of types of devices, such as a general-purpose computer, a desktop computer, a laptop computer, a tablet computer, a netbook, a mobile phone, a smartphone, a personal digital computer, a smart television device, and a server, among others. In some embodiments, the computer system 400 is an example of client device 104 or a system 200 shown in FIG. 1. Notably, FIG. 4 illustrates just one example of the computer system 400 and, in some embodiments, the computer system 400 may have fewer elements/modules than shown in FIG. 4 or more elements/modules than shown in FIG. 4.

The computer system 400 may include one or more processor(s) 402, a memory 404, one or more mass storage devices 406, one or more input devices 408, one or more output devices 410, and a network interface 412. The processor(s) 402 are, in some examples, configured to implement functionality and/or process instructions for execution within the computer system 400. For example, the processor(s) 402 may process instructions stored in the memory 404 and/or instructions stored on the mass storage devices 406. Such instructions may include components of an operating system 414 or software applications 416. The computer system 400 may also include one or more additional components not shown in FIG. 4.

The memory 404, according to one example, is configured to store information within the computer system 400 during operation. The memory 404, in some example embodiments, may refer to a non-transitory computer-readable storage medium or a computer-readable storage device. In some examples, the memory 404 is a temporary memory, meaning that a primary purpose of the memory 404 may not be long-term storage. The memory 404 may also refer to a volatile memory, meaning that the memory 404 does not maintain stored contents when the memory 404 is not receiving power. Examples of volatile memories include random access memories (RAM), dynamic random access memories (DRAM), static random access memories (SRAM), and other forms of volatile memories known in the art. In some examples, the memory 404 is used to store program instructions for execution by the processor(s) 402. The memory 404, in one example, is used by software (e.g., the operating system 414 or the software applications 416). Generally, the software applications 416 refer to software applications suitable for implementing at least some operations of the methods for versioning audio elements used in generation of music as described herein.

The mass storage devices 406 may include one or more transitory or non-transitory computer-readable storage media and/or computer-readable storage devices. In some embodiments, the mass storage devices 406 may be configured to store greater amounts of information than the memory 404. The mass storage devices 406 may further be configured for long-term storage of information. In some examples, the mass storage devices 406 include non-volatile storage elements. Examples of such non-volatile storage elements include magnetic hard discs, optical discs, solid-state discs, flash memories, forms of electrically programmable memories (EPROM) or electrically erasable and programmable memories, and other forms of non-volatile memories known in the art.

The input devices 408, in some examples, may be configured to receive input from a user through tactile, audio, video, or biometric channels. Examples of the input devices 408 may include a keyboard, a keypad, a mouse, a trackball, a touchscreen, a touchpad, a microphone, one or more video cameras, image sensors, fingerprint sensors, or any other device capable of detecting an input from a user or other source, and relaying the input to the computer system 400, or components thereof.

The output devices 410, in some examples, may be configured to provide output to a user through visual or auditory channels. The output devices 410 may include a video graphics adapter card, a liquid crystal display (LCD) monitor, a light emitting diode (LED) monitor, an organic LED monitor, a sound card, a speaker, a lighting device, a LED, a projector, or any other device capable of generating output that may be intelligible to a user. The output devices 410 may also include a touchscreen, a presence-sensitive display, or other input/output capable displays known in the art.

The network interface 412 of the computer system 400, in some example embodiments, can be utilized to communicate with external devices via one or more data networks such as one or more wired, wireless, or optical networks including, for example, the Internet, intranet, LAN, WAN, cellular phone networks, Bluetooth radio, and an IEEE 902.11-based radio frequency network, Wi-Fi networks®, among others. The network interface 412 may be a network interface card, such as an Ethernet card, an optical transceiver, a radio frequency transceiver, or any other type of device that can send and receive information.

The operating system 414 may control one or more functionalities of the computer system 400 and/or components thereof. For example, the operating system 414 may interact with the software applications 416 and may facilitate one or more interactions between the software applications 416 and components of the computer system 400. As shown in FIG. 4, the operating system 414 may interact with or be otherwise coupled to the software applications 416 and components thereof. In some embodiments, the software applications 416 may be included in the operating system 414. In these and other examples, virtual modules, firmware, or software may be part of the software applications 416.

Thus, systems and methods for versioning audio elements used in generation of music have been described. Although embodiments have been described with reference to specific example embodiments, it will be evident that various modifications and changes can be made to these example embodiments without departing from the broader spirit and scope of the present application. Accordingly, the specification and drawings are to be regarded in an illustrative rather than a restrictive sense.

What is claimed is:

1. A system for versioning audio elements used in generation of music, the system comprising:

an audio element generation engine configured to:

receive musical format data associated with a plurality of audio elements of a melody;

determine, based on the musical format data, harmonic and melodic characteristics of each of the plurality of audio elements;

match the harmonic and melodic characteristics to a plurality of chord progressions using predetermined music theory rules, counterpoint rules, and rhythm matching rules;

based on the matching and predetermined melodic movement rules, derive, from the plurality of chord progressions, melodic movement characteristics applicable to use in versioning; and based on the predetermined music theory rules and the melodic movement characteristics, create versions of the audio elements that match the chord progressions; and a memory unit in communication with the audio element generation engine, the memory unit storing at least the plurality of chord progressions, the predetermined music theory rules, the counterpoint rules, and the rhythm matching rules.

2. The system of claim 1, wherein the creating the versions of the audio elements includes determining, in the audio elements, notes that do not match one of the plurality of chord progressions and transposing the notes to fit the one of the plurality of chord progressions.

3. The system of claim 1, wherein the audio element generation engine is further configured to alter, based on the versions of the audio elements, the melody to create an altered melody.

4. The system of claim 1, wherein the audio element generation engine is further configured to:

determine genre-specific extensions associated with the plurality of audio elements; and alter the genre-specific extensions to match predetermined genre-specific extensions, wherein the creating the versions of the audio elements is further based on the altered genre-specific extensions.

5. The system of claim 4, wherein the predetermined genre-specific extensions are set and updated using a machine learning model.

6. The system of claim 4, wherein the determining the genre-specific extensions includes searching, in the plurality of audio elements, for at least one of the following:

two audio elements that play substantially the same rhythm; and two audio elements where a first audio element is stagnant and a second audio element moves around in a miscellaneous rhythm.

7. The system of claim 1, wherein the melodic movement characteristics include gradual steps and leaps, the gradual steps including scales and the leaps including arpeggios.

8. The system of claim 7, wherein the gradual steps start on a non-chord note and land on a chord note; and wherein the leaps hit chord notes presented in the chord progression.

9. The system of claim 1, wherein the audio element generation engine is further configured to:

receive the melody from a user; and provide the altered melody to the user.

10. The system of claim 1, wherein the harmonic and melodic characteristics include one or more of the following: a key, a tempo, a genre, a rhythm, and a mood.

11. A method for versioning audio elements used in generation of music, the method comprising:

receiving, by an audio element generation engine, musical format data associated with a plurality of audio elements of a melody;

determining, by the audio element generation engine, based on the musical format data, harmonic and melodic characteristics of each of the plurality of audio elements;

matching, by the audio element generation engine, the harmonic and melodic characteristics to a plurality of chord progressions using predetermined music theory rules, counterpoint rules, and rhythm matching rules;

based on the matching and predetermined melodic movement rules, deriving, by the audio element generation engine, from the plurality of chord progressions, melodic movement characteristics applicable to use in versioning; and based on the predetermined music theory rules and the melodic movement characteristics, creating, by the audio element generation engine, versions of the audio elements that match the chord progressions.

12. The method of claim 11, wherein the creating the versions of the audio elements includes determining, in the audio elements, notes that do not match one of the plurality of chord progressions and transposing the notes to fit the one of the plurality of chord progressions.

13. The method of claim 11, further comprising altering, based on the versions of the audio elements, the melody to create an altered melody.

14. The method of claim 11, further comprising:

determining genre-specific extensions associated with the plurality of audio elements; and altering the genre-specific extensions to match predetermined genre-specific extensions, wherein the creating the versions of the audio elements is further based on the altered genre-specific extensions.

15. The method of claim 14, wherein the predetermined genre-specific extensions are set and updated using a machine learning model.

16. The method of claim 14, wherein the determining the genre-specific extensions includes searching, in the plurality of audio elements, for at least one of the following:

two audio elements that play substantially the same rhythm; and two audio elements where a first audio element is stagnant and a second audio element moves around in a miscellaneous rhythm.

17. The method of claim 11, wherein the melodic movement characteristics include gradual steps and leaps, the gradual steps including scales and the leaps including arpeggios.

18. The method of claim 11, further comprising:

receiving the melody from a user; and providing the altered melody to the user.

19. The method of claim 11, wherein the harmonic and melodic characteristics include one or more of the following: a key, a tempo, a genre, a rhythm, and a mood.

20. A non-transitory computer-readable storage medium, the computer-readable storage medium including instructions that, when executed by a processor, cause the processor to:

receive musical format data associated with a plurality of audio elements of a melody;

determine, based on the musical format data, harmonic and melodic characteristics of each of the plurality of audio elements;

match the harmonic and melodic characteristics to a plurality of chord progressions using predetermined music theory rules, counterpoint rules, and rhythm matching rules;

based on the matching and predetermined melodic movement rules, derive, from the plurality of chord progressions, melodic movement characteristics applicable to using in versioning; and based on the predetermined music theory rules and the melodic movement characteristics, create versions of the audio elements that match the chord progressions.

* * * * *